US007836528B2

(12) United States Patent
Nuckton

(10) Patent No.: US 7,836,528 B2
(45) Date of Patent: Nov. 23, 2010

(54) DIFFERENTIAL TRACTION BEDDING

(75) Inventor: Deryck G Nuckton, Monterey, CA (US)

(73) Assignee: Mobility Plus LLC, Monterey, CA (US)

( * ) Notice: Subject to any disclaimer, the term of this patent is extended or adjusted under 35 U.S.C. 154(b) by 0 days.

(21) Appl. No.: 12/397,052

(22) Filed: Mar. 3, 2009

(65) Prior Publication Data

US 2010/0223725 A1 Sep. 9, 2010

(51) Int. Cl.
*A61G 1/01* (2006.01)

(52) U.S. Cl. ..... 5/81.1 HS; 5/89.1; 5/486

(58) Field of Classification Search ..... 5/925, 5/926, 486, 81.1 HS, 502, 89.1
See application file for complete search history.

(56) References Cited

U.S. PATENT DOCUMENTS

| | | | | |
|---|---|---|---|---|
| 3,849,813 | A * | 11/1974 | Neilson | 5/495 |
| 5,018,225 | A | 5/1991 | Fergni et al. | |
| 5,329,655 | A * | 7/1994 | Garner | 5/81.1 T |
| 5,742,963 | A | 4/1998 | Trevino et al. | |
| 5,787,523 | A * | 8/1998 | Lindberg | 5/81.1 HS |
| 6,658,676 | B1 * | 12/2003 | Persson et al. | 5/81.1 HS |
| 7,155,763 | B2 * | 1/2007 | North | 5/482 |
| 7,356,863 | B2 | 4/2008 | Oprandi | |

* cited by examiner

*Primary Examiner*—Michael Trettel
(74) *Attorney, Agent, or Firm*—Shimokaji & Associates, P.C.

(57) ABSTRACT

A medical linen is disclosed. The medical linen may include a base sheet with a slide surface attached to the base sheet.

9 Claims, 1 Drawing Sheet

DIFFERENTIAL TRACTION BEDDING

BACKGROUND OF THE INVENTION

The present invention generally relates to bedding, and more particularly, to a medical bed sheet or linen.

A convalescent patient or person with limited strength may spend a time alone in a bed while resting or recuperating without the assistance of another. In some cases, exemplary persons such as a convalescent or one with limited strength may wish to move themselves atop bed onto a different body position or off the bed entirely. Such exemplary persons may attempt movement by grasping at known bedding to pull themselves in a desired direction. However, known bedding underneath a person may grip the body of the person so that the bedding bunches up under the person and impedes movement of the body laterally across the bed. In other cases, secured bedding such as a bed sheet may come free of its anchor points to a mattress lessening the leverage one may have to pull their body weight across a mattress.

In one exemplary article of bedding, as shown in U.S. Pat. No. 7,356,863, it is known in the art to provide a mattress pad atop a mattress including a flexible top sheet connected to a flexible bottom sheet to form chambers accommodating portions of the human body.

As can be seen, there is a need for bedding that provides facilitated movement of a person atop a bed.

SUMMARY OF THE INVENTION

In one aspect of the present invention, a medical linen comprises a base sheet including a top surface; and a slide surface attached to the top surface of the base sheet.

In another aspect of the present invention, an article of bedding comprises a bed sheet including a length and a width and adapted for covering a mattress wherein the length includes a pair of parallel lengthwise edges and the width includes a pair of parallel widthwise edges when the bed sheet covers the mattress; and a slide surface disposed between the pair of lengthwise edges wherein a frictional coefficient of a body on the slide surface is less than a frictional coefficient of the body on the bed sheet.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Figure 1:
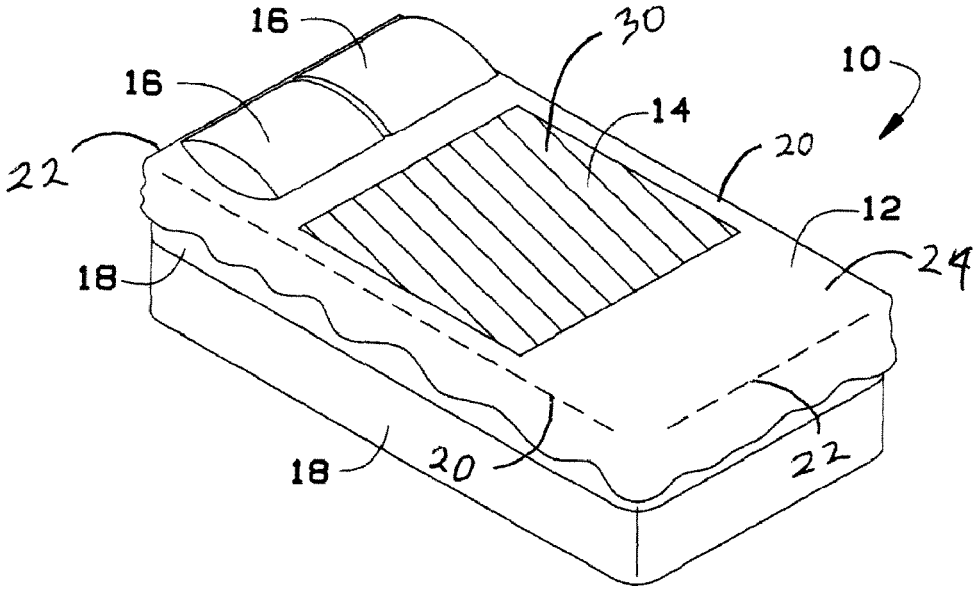
FIG. 1 is a perspective view of bedding according to one exemplary embodiment of the present invention.

Broadly, embodiments of the present invention generally provide an article of bedding with differential traction surfaces. Referring to FIG. 1, bedding 10 may comprise a base sheet 12 and a slide surface 14 attached to the base sheet 12. In an exemplary environment of use, the bedding 10 may be a medical linen where the base sheet 12 may be laid atop a mattress 18. Pillows 16 may be laid on the mattress 18 and base sheet 12 as depicted to illustrate an orientation of the base sheet on the mattress. It will be understood that the base sheet 12 may be fitted around the periphery of the mattress 18 or may lie unsecured atop the mattress.

Figure 2:
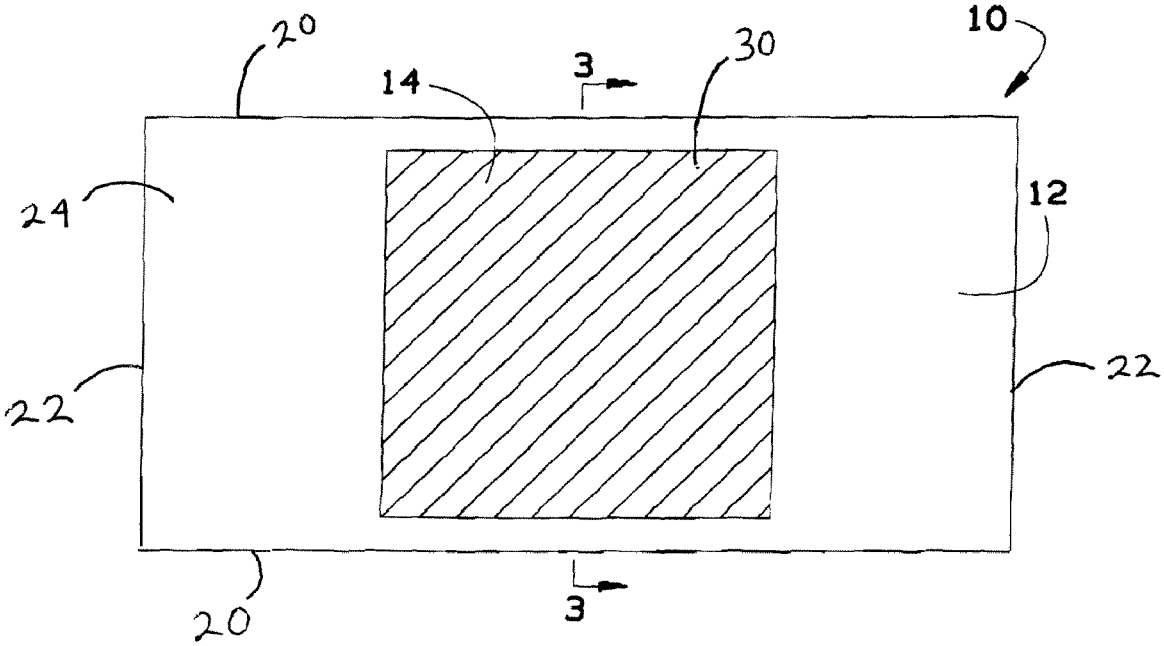
FIG. 2 is a top view according to an exemplary embodiment of the present invention.
Figure 3:
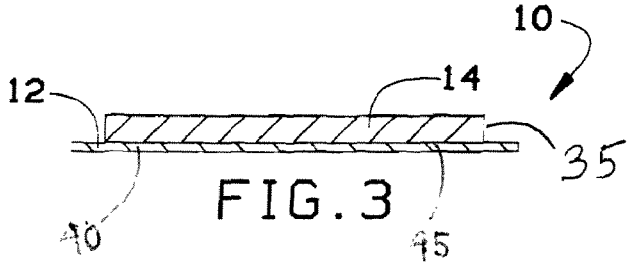
FIG. 3 is an edge view across the line 3-3 seen in FIG. 2.

Referring to FIGS. 1-3, the slide surface 14 may be constructed of a material that is of a different material than the base sheet 12. The base sheet 12 may be, in one exemplary embodiment, a bed sheet made from material with higher traction than the slide surface 14. The base sheet 12 may include a pair of parallel lengthwise edges 20 and a pair of widthwise edges 22.

In one exemplary embodiment, the slide surface 14 may be an appliqué or sheet of smooth, slick material facilitating slide against a person's body. The slide surface 14 may be laid atop a top surface 24 of the base sheet 12. The slide surface 14 may be disposed between the pair of lengthwise edges 20 and the pair of widthwise edges 22. The slide surface 14 may cover only a portion of the base sheet 12 so that less than the entirety of the top surface 24 is covered or the slide surface 14 may extend to any lengthwise edge 20 or widthwise edge 22. In an exemplary embodiment where the slide surface 14 only covers a portion of the base sheet 12, the slide surface may be constructed as a 36 inch wide by 39 inch long rectangle. On some mattresses, this may provide about 5 inches of width to the sides of the slide surface 14 and 24 inches of length above and below the slide surface 14 of exposed higher traction area in the form of the base sheet 12. Thus, the slide surface 14 may create a coefficient of friction against a patient's body that is less than a coefficient of friction created by the patient's body against the base sheet 12.

In one exemplary embodiment, the slide surface 14 may be sewn or adhesively attached to the base sheet 12 so that a periphery of the slide surface 14 does not obstruct transitional movement of a body from the slide surface 14 to the base sheet 12. In another exemplary embodiment, the slide surface 14 may be detachable and portable so that the slide surface 14 may be employed onto bedding lacking differential traction surfaces. In this embodiment and referring specifically to FIG. 3, an underside 40 of the slide surface 14 may include a high friction bottom surface 45 to grip the base sheet 12 and mitigate movement between the slide surface 14 and base sheet 12. In another exemplary embodiment, the slide surface 14 may be fabricated to lay atop the top surface 24 with a cushioned thickness 35 buffering the slide surface 14 from the top surface 24. In this embodiment, two or more layers of cloth or netting may be disposed between the slide surface 14 and the top surface 24 to create the cushioned thickness 35.

It may be appreciated that when a person with limited strength or movement lays on the bedding 10, the person's torso may lay at least partially on the slide surface 14 while the person's extremities, in some cases, may lie against the base sheet 12. When it is desired for the person to roll over or slide their body, an elbow or hand of the person can be utilized as anchor points on or in grasp of the base sheet 12 which is made from graspable material. Thus, as the person with limited strength desires facilitated movement, the hand or elbow can provide leverage counter to the base sheet 12. The torso can move across the slide surface 14 toward the grasping of the base sheet 12 with the hand or the drawing of the body toward the elbow maintaining the center of the base sheet 12 relatively in place while the torso may be free to slide along the top surface 24. Additionally, employment of the cushioned thickness 35 may provide a person added buffering against a mattress 18.

It should be understood, of course, that the foregoing relates to exemplary embodiments of the invention and that modifications may be made without departing from the spirit and scope of the invention as set forth in the following claims.

I claim:

1. A method for moving a person on a bed, the method comprising:

placing an article of bedding onto a bed, the article of bedding consisting essentially of a fitted base sheet including a top surface; and a slide surface attached to the top surface of the fitted base sheet, wherein the slide surface is disposed at a central area of the fitted base sheet such that that a user's extremities extend beyond the slide surface;

grasping the top surface of the fitted base sheet; and moving oneself along the slide surface.

2. The method of claim 1, including stopping movement of oneself upon moving beyond the slide surface.

3. The method of claim 1, including positioning the slide surface on the base sheet to include a pair of lengthwise edges along the length of the base sheet.

4. The method of claim 1, wherein the slide surface covers less than the entirety of the top surface.

5. The method of claim 1 including positioning a cushioned thickness between the slide surface and the top surface.

6. The method of claim 1, including sewing the slide surface into the base sheet as an appliqué.

7. A method for moving a person on a bed, the method comprising:

placing a portable article of bedding onto the bed, wherein the article of bedding consists essentially of:

a slide surface encompassing an entire top surface of the article of bedding; and a high friction bottom surface opposite the slide surface, wherein the high friction bottom surface retains the portable slide surface to bedding when a person moves on the bed;

grasping a top surface of the bed; and moving oneself along the slide surface without moving the portable article of bedding.

8. The method of claim 7, including grasping a fitted bed sheet fitted over the top surface of the bed.

9. The method of claim 7, including positioning a cushioned thickness between the slide surface and the top surface.

* * * * *